United States Patent [19]

Lamanna

[11] Patent Number: 4,898,382

[45] Date of Patent: Feb. 6, 1990

[54] AMUSEMENT VEHICLE GAME

[76] Inventor: Egidio Lamanna, 122 Laurelcrest Avenue, Downview, Ontario M3H 2B3, Canada

[21] Appl. No.: 367,074

[22] Filed: Jun. 16, 1989

[51] Int. Cl.[4] ..... A63B 67/00

[52] U.S. Cl. ..... 273/1 GC; 272/35; 180/2.1

[58] Field of Search ..... 273/1 G, 1 GA, 1 GB, 273/1 GC, 1 F; 180/2.1; 272/35

[56] References Cited

U.S. PATENT DOCUMENTS

| | | | |
|---|---|---|---|
| 1,373,108 | 3/1921 | Stoehrer | 272/35 X |
| 1,888,005 | 11/1932 | Markey et al. | 180/2.1 X |
| 1,982,391 | 11/1934 | Markey | 272/35 X |
| 2,916,287 | 12/1959 | Davey | 273/1 F |
| 3,529,822 | 9/1970 | Rubin | 273/1 F |
| 3,731,924 | 5/1973 | Rackman et al. | 273/1 GC |
| 3,920,242 | 11/1975 | Reith et al. | 273/1 F |
| 4,432,545 | 2/1984 | Vanderpool | 273/1 F X |

FOREIGN PATENT DOCUMENTS

| | | | |
|---|---|---|---|
| 495393 | 5/1950 | Belgium | 273/118 A |
| 946078 | 5/1949 | France | 180/2.1 |

*Primary Examiner*—Paul E. Shapiro

*Attorney, Agent, or Firm*—Lowe, Price, LeBlanc, Becker & Shur

[57] ABSTRACT

Disclosed is an amusement game using self-propelled bumper cars adapted for colliding engagement with one another. The bumper cars are provided with resilient bumpers having attack sections and target sections. A scoring arrangement is provided to tally and display a score for each car with the score being increased for contact with its attack bumper and decreased for contact with its target bumper. The scores are displayed on the cars as well as on a stationary display at the track. Excitement inducing effects such as flashing lights, sound alarms and the like are provided both on the cars and at the track and may be actuated under control of the scoring system.

19 Claims, 3 Drawing Sheets

AMUSEMENT VEHICLE GAME

BACKGROUND OF THE INVENTION

1. Field of the Invention

This invention is in the general field of self-propelled amusement vehicles and more particularly in the field of self-propelled bumper cars of the type usually found in amusement parks operated by customers upon payment of an admission.

2. Description of the Prior Art

It is well known to provide bumper cars for rent in amusement parks and carnivals for driving around a generally horizontal track or flat surface. The bumper car vehicles are equipped with resilient bumpers and a principal object of the amusement is to collide with other cars as the vehicles proceed in a generally uniform direction around the track. The tracks are usually formed of metal or are metal surfaced and the vehicles receive all or a portion of the energy for propulsion from the surface. A principal enjoyment of the operation of the vehicles lies in deliberate collision with other vehicles as well as the ability to escape collision while circling the track.

SUMMARY OF THE INVENTION

It is an object of the present invention to provide a new and improved game for play by one or more operators of uniquely equipped bumper cars that permit instantaneous score keeping to provide a measure of the success of an operator in bumping other cars and avoiding being bumped.

The bumper car vehicles comprise multi-wheeled cars that an adult or youngster of reasonable age and size can drive and operate. The vehicles may be fitted with conventional steering mechanisms and accelerators or on/off switches. They preferably are also provided with excitement inducing effects such as flashing lights, sound alarms and the like which are effective to add visual and audio excitement to the game. The vehicle motor, lights and audio sound components may be powered by conductive metal floor panels through sliding contacts on the underside of the vehicle via a suitable control circuit. The sounds may be synthesized by microchip and produced by loud speakers. The lighting effects may include neon, incandescent, strobe and laser or the like.

The vehicles of the invention include resilient bumpers which are unique in that they are divided into three general sections wherein one or more sections are electrically active. The front portion of the bumper may be called the attack bumper. Its function, as the aggressor, is to score plus or positive points. Each time the driver pursues and bumps the front bumper of his car into the target area (bumper) of another car a plus point or points are scored by the aggressor. The rear portion of the bumper of the car constitutes a target area and may be called the target bumper. When a target bumper is contacted the target vehicle is debited with minus points. Thus in a bumping engagement a plus score will be recorded on behalf of the aggressor vehicle driver who successfully accomplished the attack collision and a minus score will be recorded for the target vehicle which was impacted on the target bumper. The third section of the bumper of each vehicle comprises the sides of the vehicle. These are neutral bumpers in that they function to protect the vehicle body from damage but have no ability to score or be scored upon. The attack bumpers and the target bumpers are provided with suitable sensors for registering bumping contact and producing scoring signals. Each vehicle may be provided with a counter or processor which receives the scoring signals for totalizing the vehicle score.

A display within or adjacent the cockpit is provided for the driver or operator of the vehicle to easily observe his score. A further feature of the invention is the provision of each vehicle with a post or other mounting means carrying a second display which is preferably of an omni-directional character. This second display is preferably of such size and disposition as to display the score of the vehicle in such a manner as to be easily readable by the operators of other vehicles. The resulting ability of each operator to observe his own score against the scores of other participants results in a highly competitive game which tends to produce excitement and amusement to the players.

As a still further feature of the invention each vehicle is provided with transmitting means for transmitting a signal representative of the count of the score of that vehicle. Receiving means and associated sensors or antennas are provided in the track area for receiving the signals transmitted by the transmitting means. One or more stationary displays is provided whereon it is possible to produce a continuous display of the scores of the vehicles or at least to indicate the identity of the vehicle with the highest score. Stationary sound and light generators may be provided about the track area and these may be controlled by the scoring under control of signals from the receiving means. This adds to the general amusement of the participants in the game as well as spectators.

It is accordingly an object of the invention to provide a game apparatus comprising at least one and preferably multiple self-propelled vehicles capable of carrying and being steered by an operator. The vehicle has a forward portion comprising a forward bumper means and a rearward portion comprising a rearward bumper means. Both bumper means are resiliently mounted on the vehicle and adapted for bumping contact with bumper means on other vehicles. Switch means are provided on the vehicle adapted to be actuated by the bumper means. A counter or processor is provided on the vehicle and connected to be actuated by the switch means to increment in one direction upon actuation by the forward bumper and to decrement in the opposite direction upon actuation by the rearward bumper. Display means are provided on the vehicle and associated with the counter or processor for displaying the count thereof. A second display means is mounted on the vehicle and associated with the counter or processor for displaying the count of the counter means in such a manner that the second display is readable at a distance from the vehicle by operators of other vehicles. Transmitting means may also be provided on the vehicle for transmitting a signal representative of the count of the counter means. Receiving means are provided for receiving the signal transmitted by the transmitting means and stationary display means responsive to the received signals are provided to generate a display representative of the score of at least the highest scoring vehicle and indicating the identity thereof.

It is a further object of the invention to provide audio and visual effect producing devices which may be controlled by the bumping to produce distinctive sounds and visual effects as a result of the different types of engagement. Stationary sound and light producing devices may be provided to enhance the excitement of the game for onlookers, such as an audio and visually enhanced scoreboard.

BRIEF DESCRIPTION OF THE DRAWINGS

The above and other objects, features and advantages of the invention will become more apparent from a consideration of the following detailed description presented in connection with the accompanying drawings in which:

Referring to FIG. 1 there is shown an embodiment of the game being played upon a track generally indicated at 10 disposed about a traffic island 12 having a center pedestal 14. The pedestal 14 may be provided with scoring displays as well as devices for creating audio and visual effects such as lights, sound, music, video, lasers and the like. The track 10 may be provided with a conventional sectioned conductive floor 16 to provide electrical power to the underside of the vehicles. A vertical retaining wall 18 extends peripherally about the track to confine the vehicles. A plurality of vehicles 20 each having an operator 22 is shown proceeding counterclockwise around the track.

Figure 1:
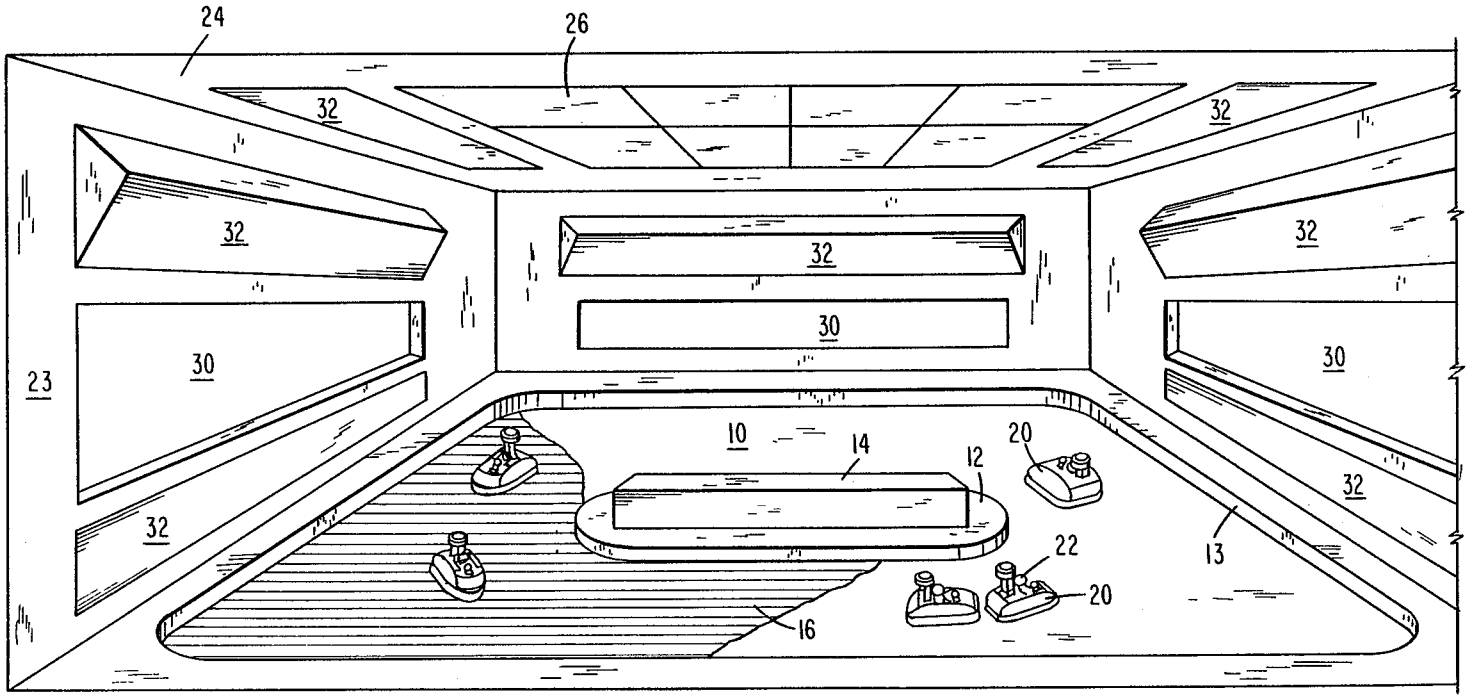
FIG. 1 is a perspective view of a typical track for use in accordance with the principles of the invention illustrating a series of vehicles in operation.

A ceiling 24 extends over the track and is provided with a grid 26 of receiver sensors or receiving antennas for receiving the scoring signal information from the vehicles. Side walls 28 surround the track and may be provided with suitable openings 30 for spectator galleries. The walls 28 and ceiling 24 may be provided with display arrays 32 for scoring as well as providing lights, sound, music and other effects similar to those mounted on the center pedestal 14.

Figure 2:
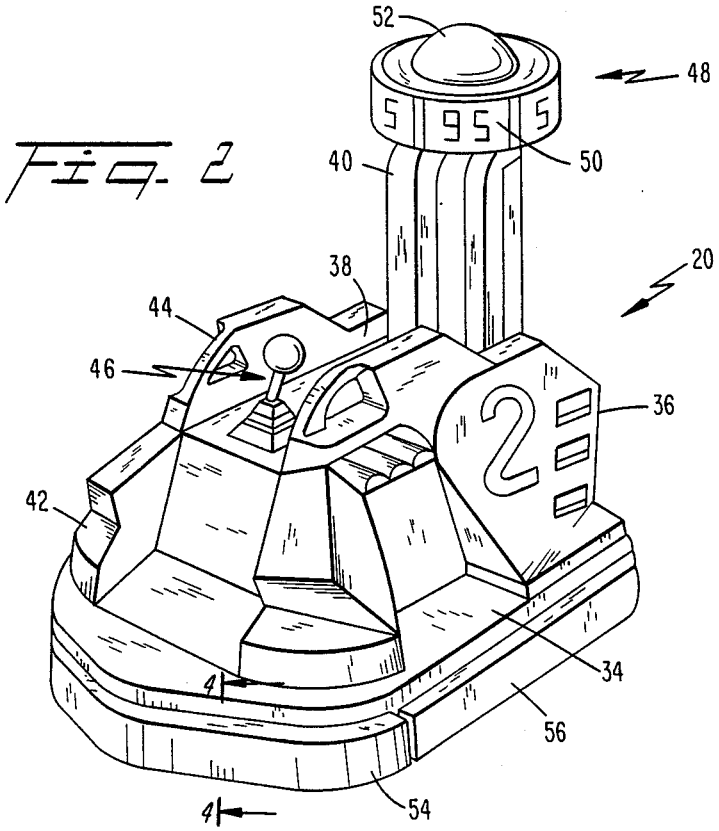
FIG. 2 is a perspective view of an embodiment of vehicle constructed according to the invention.

Referring to FIG. 2 there is shown at 20 a typical decorative vehicle constructed according to a preferred embodiment of the invention. The vehicle generally indicted at 20 is provided with multiple wheels (not shown) some of which are steerable in a conventional fashion. The vehicle chassis 34 carries a housing or body 36 which surrounds an operator cockpit 38 having a padded seat 40. Suitable foot wells 42 may be provided along with hand holds 44 to assist an operator in entering the cockpit. Steerage of the vehicle may be effected in any suitable manner, such as by wheel, joy stick or tiller. A joy stick 46 is illustrated in FIG. 2 by way of example.

Mounted atop the padded seat 40 is an omni-directional display 48 comprised of multiple digital display panels 50. A dome 52 covers a transmitting device as is presently described. Mounted about the lower periphery of the chassis 34 is an encircling bumper comprised of a forward or attack bumper 54, side or neutral bumpers 56 and a rear bumper generally indicated at 58 in FIG. 3.

Figure 4:
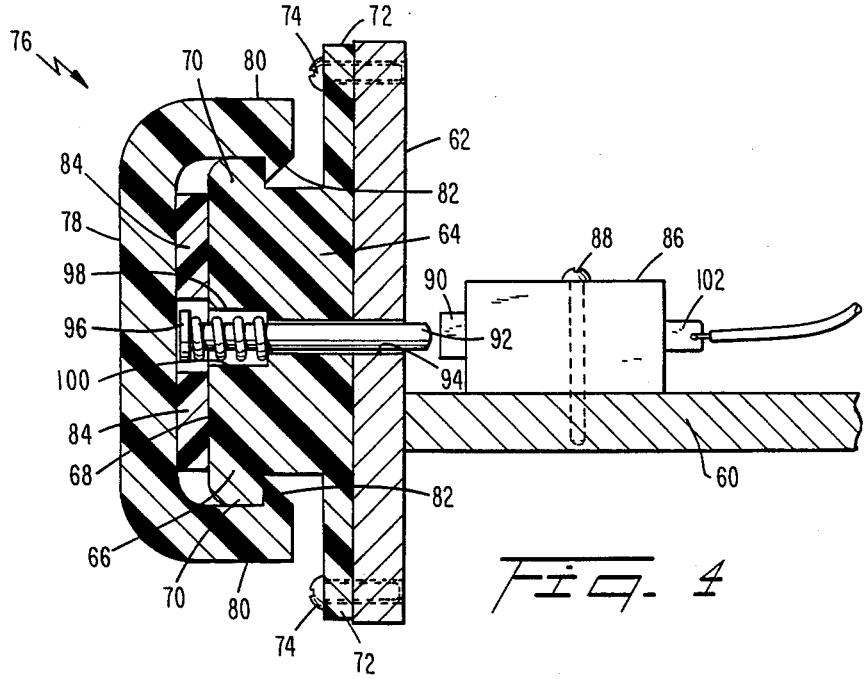
FIG. 4 is a partial vertical section of the front bumper taken on the line 4—4 of FIG. 2.

The attack bumper 54 is curvate and is provided with one or more sensors for registering bumping contact. One such sensor is illustrated in FIG. 4. Referring to FIG. 4 the floor 60 of the vehicle chassis has mounted about its outer periphery a rail 62 of suitable strength to withstand the repetitive bumping impact for which the bumper cars are intended. The rail 62 may be formed of a suitable gauge metal which may be welded or otherwise rigidly attached to the floor 60. The floor 60 and chassis 34 are constructed in such a manner as to withstand the rough usage for which they are designed.

Attached to the rail 62 and extending thereabout is a synthetic resin bumper mounting strip 64 having an outwardly extending body 66 terminating in an outer peripheral face 68. The outer face 68 is of a larger width than the body 66 to provide upper and lower flanges 70. The rightmost surface of the mounting strip 64 as seen in the sectional depiction in FIG. 4 is provided with mounting flanges 72 secured to the rail 62 as by screws 74.

Mounted over the bumper mounting strip 64 is a bumper cover generally indicated at 76. The bumper shown in FIG. 4 is the front bumper. The bumper cover 76 has a channel shaped cross-section comprising a generally vertically disposed impact wall 78 and generally parallel and horizontal side walls 80. The ends of the side walls 80 carry inwardly extending securing lips 82 which have under surfaces which lockingly engage the flanges 70 of the body 66 of the bumper mounting strip 64. The outer surfaces of the lips 82 are diagonally shaped to facilitate snapping the bumper cover into position over the flanges 70 of the bumper mounting strip 64. The bumper cover 76 is preferably formed of synthetic resin and the bumper cover and bumper mounting strip may be formed by way of example from the synthetic resin sold under the trademark "Delrin."

Mounted between the outer surface 68 of the bumper mounting strip 64 and the inner surface of the channel of the bumper 76 are multiple segments 84 formed of a resilient synthetic resin such as that sold under the trademark "Poron." The segments 84 provide a resilient cushioning for the outer bumper cover against the surface 68 of the bumper mounting strip to provide the desired movement between outer bumper cover and bumper mounting strip during impact with the bumpers of other vehicles.

A typical sensor for scoring of impact is now described. Such a sensor may be comprised of a microswitch 86 suitably fastened to the floor 60 as by screw 88. The actuating button 90 of the microswitch 86 is mounted for engagement with a switch plunger rod 92. The rod 92 slidably extends through a suitable aperture 94 in the rail 62 and bumper mounting strip 64. The outer end of the plunger rod is provided with an enlarged head 96 for restraining one end of a compression coil spring 98 received in a counterbore 100 in the mounting strip 64. Suitable electrical connections 102 are provided to the microswitch 86. The plunger 92 may be formed of any suitable material such as metal or synthetic resin such as "Delrin."

It will be apparent that impact on the outer bumper cover surface 78 will compress the Poron segments 84 and coil spring 100 to force the rod 92 into actuating engagement with the button 90 on the microswitch 86 to make a momentary contact therein. While a single microswitch is illustrated in FIG. 4 it will be appreciated that multiple switches of a similar type may be disposed in spaced fashion about the periphery of the curvate bumper 54.

Figure 3:
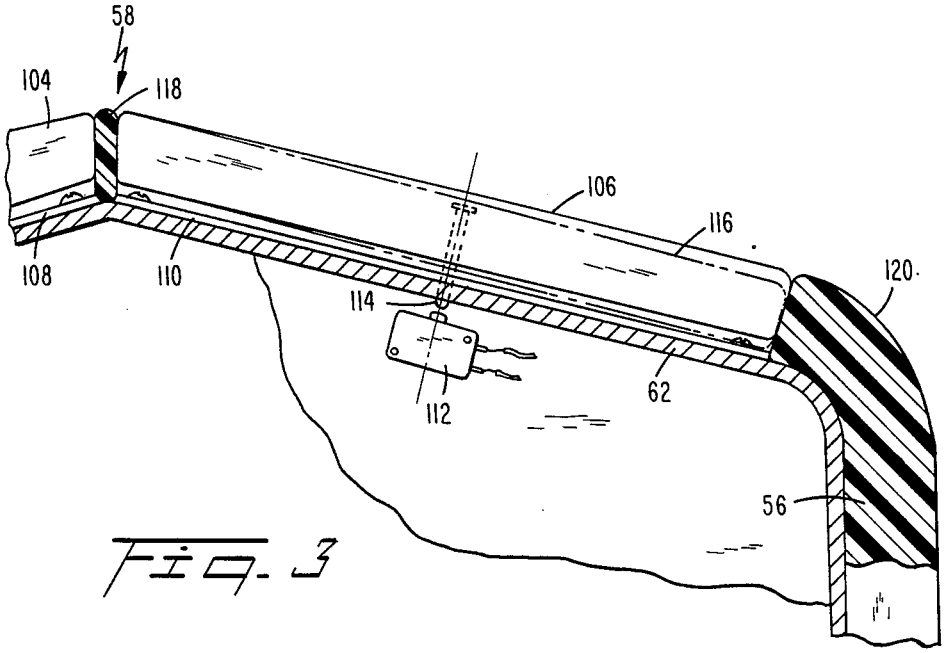
FIG. 3 is a plan view partially in section illustrating a form of rear bumper construction.

Referring to FIG. 3 there is illustrated a form of sectional rear bumper generally indicated at 58. It will, be appreciated that this bumper also could be provided in curvate form or that, conversely, the curvate front bumper 54 could be provided in sectional form. Referring to FIG. 3 the rear bumper 58 is shown as comprised of a pair of straight sections 104 and 106. The cross-sections of these bumpers are similar to that illustrated in FIG. 4 with each straight section comprising an outer bumper guard mounted upon a bumper mounting strip 108 and 110 fastened to the chassis rail 62 in the same manner as illustrated in FIG. 4. A microswitch 112 is shown mounted behind the rail 62 and bumper 106 for actuation by a plunger indicated diagrammatically at 114.

The solid line bumper 106 is shown in an impacted or depressed condition by broken lines as indicated at 116. This position of the bumper guard results from a blow at the right end thereof in FIG. 3 depressing the resilient segments 84 sufficiently to actuate the switch 112. As with the front bumper it will be appreciated that it would be possible to provide a plurality of switches in spaced disposition along the bumper 106. Between the bumper sections 104 and 106 in FIG. 3 there is seen a synthetic resin divider 118. This may be formed of a resin such as "Delrin" and fastened to the rail 62 in any suitable fashion. The neutral bumpers 56 are illustrated in FIG. 3 as having inwardly curved ends 120 extending to spacedly abut the ends of the rear bumpers 104 and 106. The neutral bumpers 56 may be formed of Delrin or similar synthetic resin.

Figure 5:
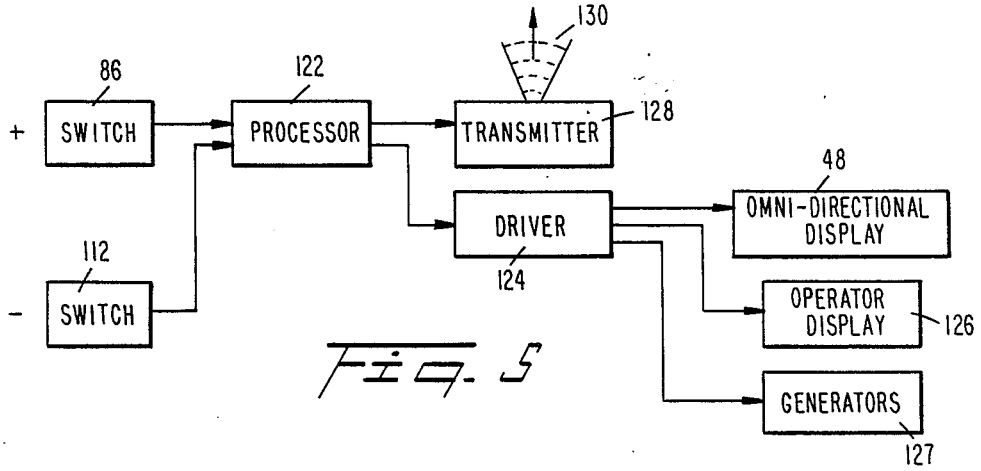
FIG. 5 is a diagrammatic illustration of the connection of the bumper actuated switches to the displays and scoring system.

Referring to FIG. 5 there is shown in diagrammatic form the scoring and display system of the invention. The attack bumper microswitch is shown at 86 while the target bumper microswitch is shown at 112. It will be appreciated that while the switches 86 and 112 are shown as single items in this diagrammatic illustration multiple "plus" and multiple "minus" switches may be provided. These attack and target switches are connected to a suitable vehicle mounted processor 122 which provides a continuous totalization of the score as it is incremented and decremented by actuation of the attack and target switches. The current score is fed to a driver 124 connected to actuate the digital displays 50 in the omni-directional display 48. Also mounted on the vehicle 20 in or adjacent the cockpit in a position to be readily observed by the operator is an operator display 126. The operator display 126 may, for example, be mounted at the base of the joy stick control 46 in FIG. 2. This operator display permits the operator to readily observe his own score while attempting to keep track of the score of other operators by observation of their omni-directional displays 48. The driver 124 may also control vehicle mounted sound and light effect generators and the nature of the sound and light may be determined by whether the driver produces a plus or a minus change in the score. Such vehicle mounted sound and light effect generators are indicated graphically at 127 in FIG. 5.

Figure 6:
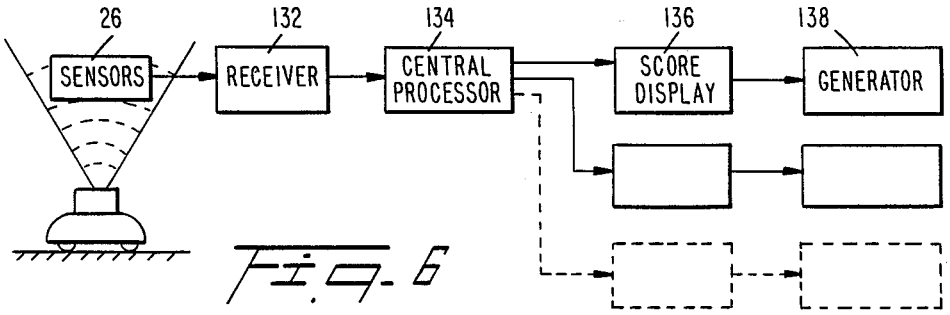
FIG. 6 is a diagrammatic illustration of the relationship of the transmitting system to the stationary displays.

Each vehicle is provided with a suitable transmitter 128 for transmitting a wave signal indicated at 130 directed toward the roof of the track. The transmitter is preferably of the infrared type and may radiate upwardly from the dome 52 in FIG. 1. The infrared transmitters in each vehicle may transmit suitably modulated and encoded signals for transferring the vehicle identity and score in their emitted signal. Referring to FIGS. 1 and 6 the ceiling 28 is provided with a receptor grid of sensors 26 feeding a receiver 132 for separating and demodulating the composite received signal and feeding its output to a central processor 134. The processor 134 in turn drives individual score displays 136 and visual and audible effect generators 138 which generate light and sound in response to the scoring. The scores are suitably displayed in the ceiling and wall mounted arrays 32 illustrated in FIG. 1.

In operation the termination of a game will result in the deenergization of the drive of the vehicles and this in turn zeros the displays on each vehicle and zeros the signal being transmitted via the vehicle mounted transmitters.

Upon commencement of the next game the operators are seated in their respective vehicles, the floor of the track is energized and the various vehicles become operative under the control of the operators. The vehicles thereupon commence their movement around the track. Referring to FIG. 1 three vehicles are shown proceeding about the track in spaced relation while in the lower righthand corner of FIG. 1 there is shown an attack-to-target bumper contact between two vehicles. The impact of the attack bumper of the attack vehicle upon the target bumper of the target vehicle will result in incrementing or increasing of the score of the attack vehicle while decrementing or decreasing the score of the target vehicle. These scores will immediately become apparent to the operators on their operator displays as well as on the omni-directional displays 48 at the head of the seats. Sound and light effects will be simultaneously produced on the vehicles.

The scores will be simultaneously transmitted via the transmitters 128 to the sensors 126 and displayed on the stationary arrays 32 disposed about the track area. Also simultaneously the scoring will actuate the sight and sound generating devices to add to the general excitement not only to the participants or operators but also to the spectators at the game.

The invention may be embodied in other specific forms without departing from the spirit or essential characteristics thereto. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. Game apparatus comprising:

a self-propelled vehicle capable of carrying and being steered by an operator;

said vehicle having a forward portion and a rearward portion;

forward bumper means mounted on said forward portion and rearward bumper means mounted on said rearward portion;

said bumper means being resiliently mounted on said vehicle and adapted for bumping contact with bumper means on other vehicles;

switch means on said vehicle adapted to be actuated by said bumper means;

counter means on said vehicle adapted to be actuated by said switch means to increment in one direction upon actuation by said forward bumper means and to decrement in another direction upon actuation by said rearward bumper means; and display means on said vehicle and associated with said counter means for displaying the count thereof.

2. Game apparatus according to claim 1 including transmitting means on said vehicle for transmitting a signal representative of the count of said counter means;

receiving means for receiving the signal transmitted by said transmitting means;

stationary display means responsive to said received signal to generate a display representative thereof.

3. Game apparatus according to claim 2 including noise generating means stationarily mounted and associated with said receiving means for actuation in response to signals from said receiving means.

4. Game apparatus according to claim 2 including light generating means stationarily mounted and associated with said receiving means for generation of light in response to signals from said receiving means.

5. Game apparatus according to claim 1 including second display means mounted on said vehicle and associated with said counter means for displaying the count of said counter means in such a manner that said second display is readable at a distance from said vehicle.

6. Game apparatus according to claim 5 wherein said second display means includes multiple displays readable from multiple directions about said vehicle.

7. Game apparatus according to claim 5 wherein said second display means comprises the highest portion of said vehicle.

8. Game apparatus according to claim 1 including noise generating means mounted on said vehicle and associated with said switch means for producing noise signals upon actuation of said switch means.

9. Game apparatus according to claim 1 including light generating means mounted on said vehicle and associated with said switch means for generating light upon actuation of said switch means.

10. Game apparatus comprising multiple steerable self-propelled vehicles capable of carrying an operator;

said vehicles having multiple bumper means mounted thereon for bumping engagement between the bumper means of different vehicles;

each of said vehicles having a forwardly mounted bumper means associated with switch means and rearwardly mounted bumper means associated with switch means wherein said switch means are disposed for activation by bumping of their respective bumper means;

each of said vehicles having counting means connected to said switch means so as to be incremented by bumping of said forwardly mounted bumper means and decremented by bumping of said rearwardly mounted bumper means; and display means mounted on each of said vehicles and connected to said counting means for displaying the count thereof.

11. Game apparatus according to claim 10 including transmitting means on each of said vehicles for transmitting a signal representative of the count of said counting means;

receiving means for receiving the signals transmitted by said transmitting means;

stationary display means responsive to said received signals to generate a display indicative of the vehicle having the highest score.

12. Game apparatus according to claim 11 including noise generating means stationarily mounted and associated with said receiving means for actuation in response to signals from said receiving means.

13. Game apparatus according to claim 11 including light generating means stationarily mounted and associated with said receiving means for generation of light in response to signals from said receiving means.

14. Game apparatus according to claim 10 including means for supplying from a stationary source to said vehicles electric power for propelling said vehicles; and timing means for deenergizing said power supply means at the end of a predetermined period of time and zeroing said counter means.

15. Game apparatus according to claim 10 wherein each of said vehicles includes second display means mounted on said vehicles and associated with said counting means for displaying the count of said counting means in such a manner that said second display is readable at a distance from said vehicle.

16. Game apparatus according to claim 15 wherein said second display means includes multiple digital displays readable from multiple directions about said vehicle.

17. Game apparatus according to claim 15 wherein said second display means is mounted at substantially the highest portion of each of said vehicles.

18. Game apparatus according to claim 15 including noise generating means on each of said vehicles and associated with said switch means for producing noise signals upon actuation of said switch means.

19. Game apparatus according to claim 15 including light generating means mounted on each of said vehicles and associated with said switch means for generating light upon actuation of said switch means.

* * * * *